US008082929B2

(12) United States Patent
Kim

(10) Patent No.: US 8,082,929 B2
(45) Date of Patent: Dec. 27, 2011

(54) HAIR IRON

(75) Inventor: Hae Jin Kim, Seoul (KR)

(73) Assignee: GHD Korea, Inc., Chungcheongnam-do (KR)

( * ) Notice: Subject to any disclaimer, the term of this patent is extended or adjusted under 35 U.S.C. 154(b) by 183 days.

(21) Appl. No.: 12/656,214

(22) Filed: Jan. 21, 2010

(65) Prior Publication Data

US 2011/0174331 A1 Jul. 21, 2011

(51) Int. Cl.
*A45D 1/04* (2006.01)

(52) U.S. Cl. ..... 132/232; 132/223

(58) Field of Classification Search ..... 132/223–232
See application file for complete search history.

(56) References Cited

U.S. PATENT DOCUMENTS

2005/0081876 A1* 4/2005 Choi ..... 132/224

* cited by examiner

*Primary Examiner* — Rachel Steitz
(74) *Attorney, Agent, or Firm* — Bacon & Thomas, PLLC

(57) ABSTRACT

A hair iron includes upper and lower casings defining a grip portion and coupled to each other at a first end with an elastic coupler such that the casings in the side of a second end opposite to the first end are pivotable within a certain angular range about the first end, an upper heater block extending in a longitudinal direction of the upper casing and coupled on the second end of the upper casing which is not coupled with the lower casing, a lower heater block extending in a longitudinal direction of the lower casing and coupled on the second end of the lower casing which is not coupled with the upper casing.

6 Claims, 5 Drawing Sheets

【FIG. 1】
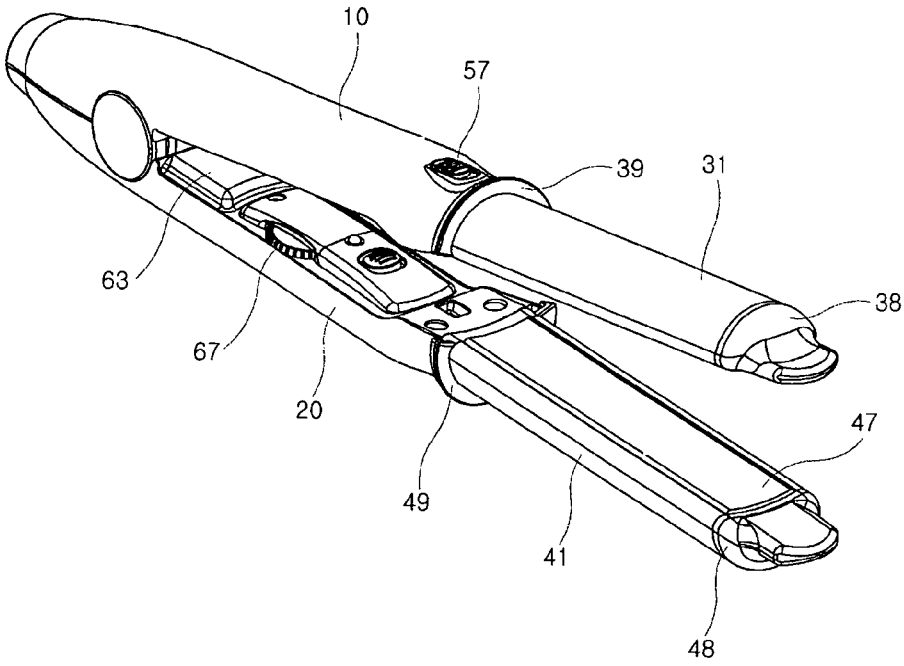

【FIG. 2】
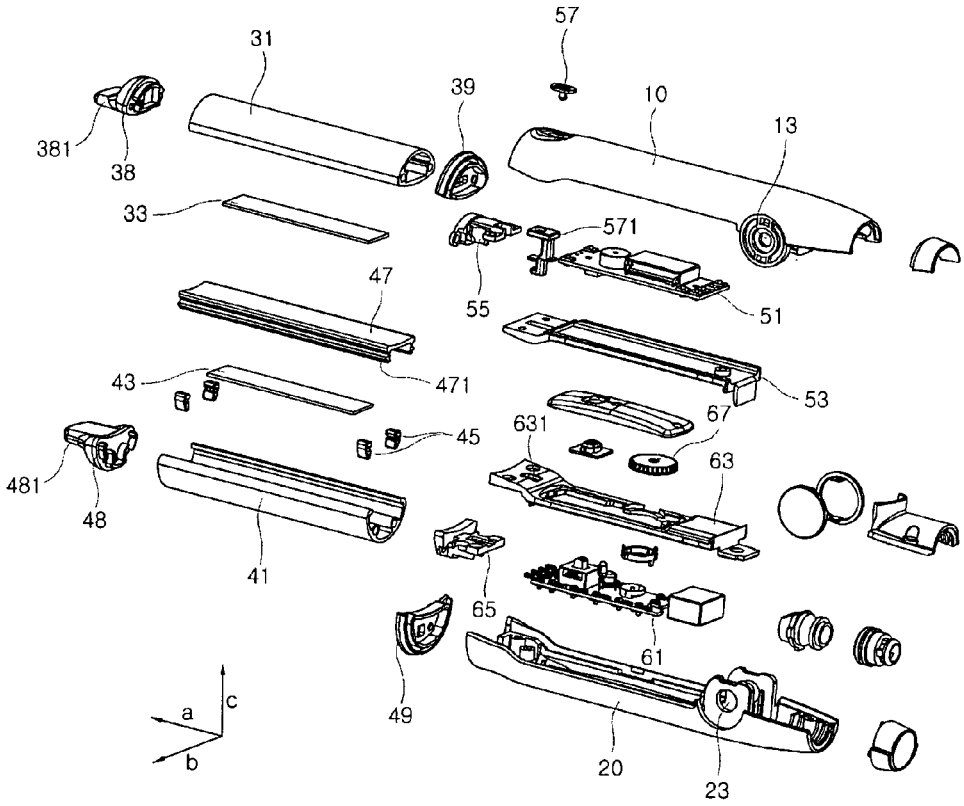

【FIG. 3】
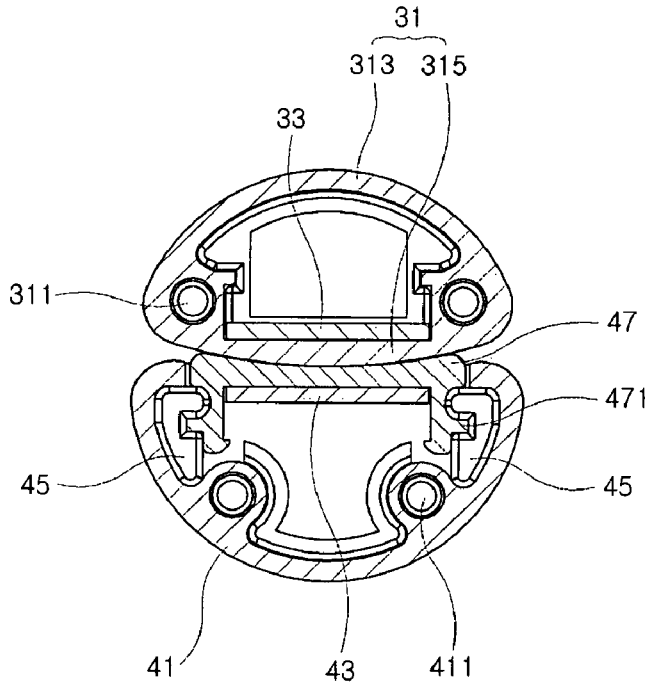

【FIG. 4】
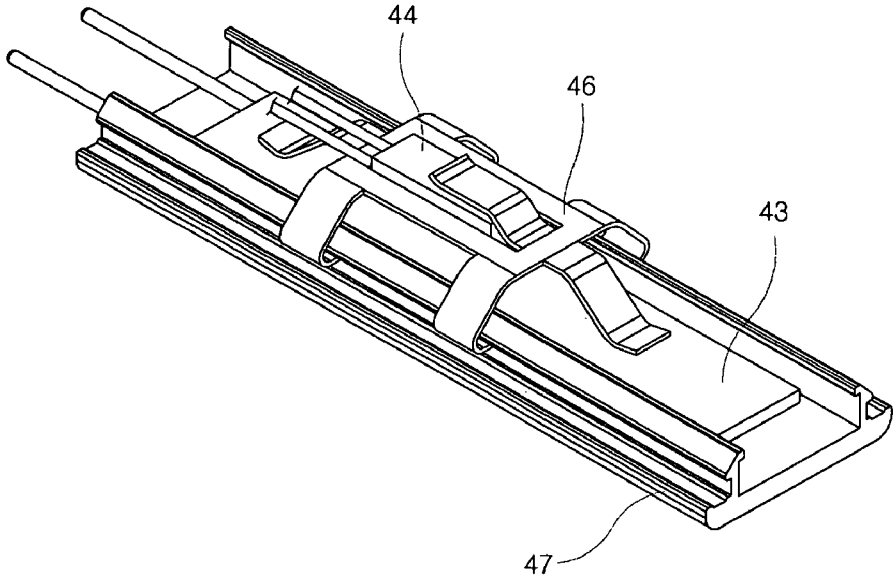

【FIG. 5】
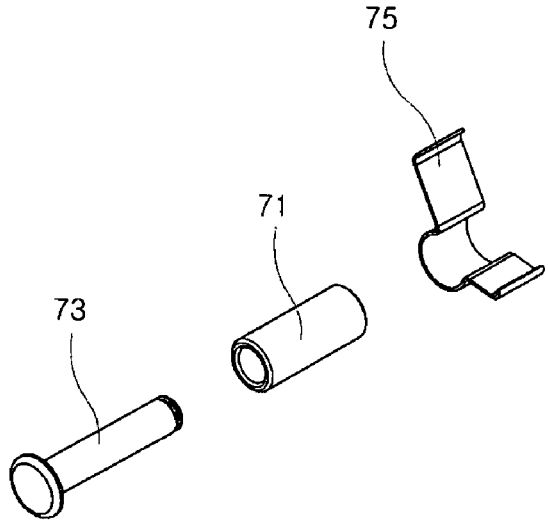

HAIR IRON

BACKGROUND OF THE INVENTION

1. Field of the Invention

The present invention relates, in general, to a hair iron and, more particularly, to a hair iron which makes both curling and straightening of the hair easy.

2. Description of the Related Art

Generally, a hair iron is a tool used to shape various kinds of hairstyles with the help of heat and is widely used in hairdressing salons.

In such a hair iron, a hot portion which is highly heated and comes in contact with the hair is formed like a flat plate or formed as a curved surface like the side surface of a cylinder or rod. In general, it has been known that the flat plate type is advantageous for straightening the hair and that the curved surface type is suitable for curling the hair.

The hot portion is generally provided with a means for closely holding the hair on that portion in order to make the shaping of the hair convenient and efficiently transfer heat therebetween.

Thus, the conventional plate type hair iron includes a pair of upper and lower casings, which are coupled with each other such that the assembly rotates at a certain angle about a hinge axis while elements such as a hinge, a spring and the like are provided in the longitudinal ends of the casings. Further, heater plates are provided on inner surfaces (i.e. opposite surfaces) of the upper and lower casings longitudinally opposite to the hinge in order to transfer heat, so that the hair is shaped while being picked up between the heater plates.

Further, inner covers are provided on inner surfaces of the upper and lower casings proximal to the hinge so as to cover a conducting wire, which extends from an external source to an electric device such as a heater installed in the side of the heater plate, and a control circuit.

In the flat plate type hair iron, the heater plate is configured such that a heater is provided on the surface opposite the hair-contact surface so as to generate heat and transfer the heat to the heater plate. Here, upon installation in the casings, the heater and the heater plate are installed not to directly come into contact with the casings in such a manner that they are installed in a holder, which is composed of heat-resistant synthetic resin, and the holder is separately inserted into the casings.

A main body of the cylinder type hair iron, in which the rod or cylinder type portion comes in contact with the hair so as to curl the hair, comprises grip portions held by a hand and rod or cylinder type heating sections which come in contact with the hair for heating when viewing the main body in a longitudinal direction. A clamp is installed on the main body using a hinge, a spring, and the like in order to make the hair fixedly adhere between the heating sections. The clamp is operated so that when a portion in the side of the grip portions is forcedly held with the hand or is released from being held, the remaining portion of the grip portion moves closer towards or farther away from the heating sections with a lever system.

In the plate type hair iron, since a flat plate type heater plate is installed on the inner surfaces of the upper and lower casings and applies heat to the hair, the plate type hair iron is not suitable for curling the hair. That is, if a user curls the hair using the plate type hair iron, it is difficult to, first, obtain a natural curling hairstyle because of the shape of the plate which the hair makes contact with, and secondly to make the hair smoothly slide along the surfaces of the plates because the hair is intensively curled only at edges of the wide ends of the plates, which causes the hair to become damaged or pulled out, or the scalp to suffer pain.

On the contrary, if the curved type hair iron straightens the hair, it is difficult to implement efficient heating because the contact area between the curved heating section and the hair is very small.

Therefore, it is difficult or problematic to straighten and curl the hair at the same time using a single hair iron of the plate type or the curved type. However, for the general public, purchasing various kinds of hair irons for curling and straightening the hair is inefficient because of high purchasing expense, large storage space, and particularly, it being inconvenient to carry the hair irons.

SUMMARY OF THE INVENTION

Accordingly, the present invention has been made keeping in mind the above problems occurring in the related art, and the present invention intends to propose a hair iron having a structure capable of easily implementing shaping a hairstyle through straightening, curling or the like.

Another object of the present invention is to provide a hair iron having a structure capable of efficiently implementing shaping a hairstyle without being inconvenient to use.

In order to achieve the above objects, according to one aspect of the present invention, there is provided a hair iron including: upper and lower casings defining a grip portion and coupled to each other at a first end with an elastic coupler such that the casings in the side of a second end are pivotable within a certain angular range about the first end; an upper heater block extending in a longitudinal direction (of the upper casing) and coupled on the second end of the upper casing (which is not coupled with the lower casing); a lower heater block extending in a longitudinal direction of the lower casing and coupled on the second end of the lower casing which is not coupled with the upper casing, wherein the upper heater block has a semi-cylindrical heating section and a first heater attached to an inner part of the heating section, wherein the lower heater block has a concave heating section, a heater plate and a second heater attached to a surface of the heater plate which is not exposed outside, the heater plate being coupled onto a concave portion of the concave heating section by the medium of a heat-resistant elastic body, thereby defining the semi-cylindrical shape of the lower heater block, wherein the heater plate moves nearer towards the concave heating section or tilts (or pivots) about its longitudinal axis by the action of the elastic body so as to vary its position relative to the concave heating section.

In an exemplary embodiment, one block of the upper and lower heater blocks may have larger width than the other block and have a concave surface so as to overlap with a convex surface of the outer block.

In an exemplary embodiment, heat-resistant, heat-insulating caps may be provided on the heater blocks in the side of the second end, the heater blocks being coupled at the first end with the upper and lower casings, such that a user holds portions of the caps by hand and shapes a hairstyle. Here, the cap may be composed of heat-resistant, heat-insulating synthetic resin.

In an exemplary embodiment, a lock may be provided, which when a user forcedly holds the upper and lower blocks so as to catch the hair therebetween and then releases his hold, maintains the holding state.

According to the construction of the present invention, the hair iron can efficiently implement shaping of various kinds of hairstyles, including straightening, curling and the like without any inconvenience of use.

BRIEF DESCRIPTION OF THE DRAWINGS

The above and other objects, features and advantages of the present invention will be more clearly understood from the following detailed description when taken in conjunction with the accompanying drawings, in which:

FIG. 1 is a perspective view illustrating a hair iron according to an embodiment of the present invention;

FIG. 2 is an exploded perspective view illustrating the hair iron according to an embodiment of the present invention;

FIG. 3 is a cross-sectional view illustrating upper and lower heater blocks;

FIG. 4 is a perspective view illustrating a heater, a heater plate, a fuse and a fuse-fixing spring, which are assembled with each other; and FIG. 5 is a perspective view illustrating a hinge consisting of a hinge axis and a spring.

DETAILED DESCRIPTION OF THE INVENTION

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is a perspective view illustrating a hair iron according to an embodiment of the present invention, and FIG. 2 is an exploded perspective view illustrating the hair iron according to an embodiment of the present invention.

A grip portion of the hair iron of the present invention has the shape similar to the conventional plate type hair iron. Upper and lower casings 10 and 20 define the grip portion and are coupled, at a first end in the longitudinal direction 'a', with each other, using a hinge and a spring installed around the hinge. Not shown in the drawing is an electric wire which is drawn out from the first end and connected to an external power source.

The upper and lower casings 10 and 20 each are formed with a concave section which is composed of synthetic resin. In the concave sections, a conductive wire, which connects the electric wire to heaters 33 and 43 installed in heater blocks for heating hair so as to supply power, and a PCB 51 and 61 constituting a control circuit for controlling power supply are installed. If needed, a fan (not shown) may be installed at that location. The upper and lower casings are assembled such that when the conductive wire and the PCB are included in the respective concave sections, the concave sections are covered with covers 53 and 63. A radial switch 67 or the like may be installed on the cover portion with at least a portion of the switch exposed to the outside, in order to regulate a temperature controller or the like, which is installed in the PCB 51 and 61.

Onto the second ends of the upper and lower casings 10 and 20, which are opposite to the first end to which the electric wire is introduced, upper and lower heater blocks are coupled as if they extend from the upper and lower casings in the longitudinal direction.

FIG. 3 is a cross-sectional view illustrating upper and lower heater blocks.

The upper heater block coupled to the upper casing 10 is a semi-cylindrical heating section including a metal barrel 31 of a semi-circular section and a heater 33 closely provided in the metal barrel, which are integrally formed. A fuse or PTC (Positive Thermal Coefficient) is attached to the heater 33 so as to cut off power if the hair iron is overheated.

The cross-section form of the metal barrel 31 consists of a substantially semi-circular circumference 313 and a substantially diametrical line portion 315 which corresponds to a diametric line of the semi-circular portion. The diametrical portion 315 is not a linear line, but curved at a curvature, protruding outside. The crossing portion of the circumference 313 and the diametrical portion 315 is not angled, but smoothly curved, and is composed of a thick portion of the metal barrel 31. A hole 311 is formed in the thick portion of the crossing portion. The hole 311 extends through the overall length of the metal barrel 31 and connects opposite sides of the longitudinal direction 'a' to each other.

The opposite longitudinal sides of the metal barrel 31 are covered with caps 38 and 39, which are composed of heat-resistant, heat-insulating synthetic resin. Here, the heat-resistance and the heat-insulating property pertain to a concept which is general and common in the related art, and the composition material is selected from known synthetic resins. For example, the synthetic resin constituting the caps 38 and 39 can resist e.g. 200° C. or 220° C. or more, which is the maximum temperature that the hair iron treats hair at, and has greater heat insulation compared to the heater blocks, which come in contact with the hair and transfer heat to the hair for curling or straightening the hair, so that upon being touched by the hand, there is no risk of a person suffering a burn.

To the cap 39, which is installed in the end side where the upper heater block is coupled with the upper casing 10, a coupler member 55 is coupled for coupling with the upper casing 10. Here, the metal barrel 31, the opposite caps 38 and 39 thereof, and the coupler member 55 all are fastened to each other by a long bolt (not shown), which is screwed through their respective holes.

The coupler member 55, apart from the hole which is open in the longitudinal direction a, has another hole which is open in the thickness direction c, through which hole the coupling member 55 can be coupled both to the semicylindrical upper casing 10 and to the cover 53 covering an open side of the upper casing 10. That is, holes of the coupler member 55, the upper casing 10, and the cover 53 are aligned and then a bolt (not shown) is screwed through the holes, thereby combining the elements.

The lower casing 20 and the lower heater block are assembled similar to the case of the upper casing and the upper heater block. However, the lower heater block has a structure different from the upper heater block. That is, the upper heater block has the metal barrel 31 with a semi-circular cross-section, whereas the lower heater block includes a groove 41 (a groove type heating section) and a heater plate 47 which closes an open portion of the groove 41. A heater 43 is installed on a back surface of an exposed surface of the heater plate 47. A protrusion 471 of the heater plate 47, which protrudes out in the width direction from the skirt, which is bent towards the back surface from the opposite wide ends of the heater plate 47, is fixedly inserted into a groove of a silicone pad 45. The silicone pad 45 becomes inserted in a corresponding hole provided in the groove 41 of the lower heater block. The silicone pad 45 has heat resistance by which the maximum temperature of the heater plate 47 can be endured.

Then, if the heater plate 47 is pressurized from the outside while closing the open portion of the groove 41, it is generally pressed towards the center of the groove 41 by means of elasticity of the silicone pad 45, or otherwise it tilts such that if one end in the width direction 'b' is pressurized, the other end pops up, and vice versa.

Meanwhile, the width of the lower heater block is slightly larger than the width of the upper heater block. The heater plate 47 is not completely flat, but slightly concave, such that it overlaps the convex shape of the diametrical portion 315 of the metal barrel 31 of the upper heater block. That is, when viewing from the cross-section of the heater plate 47, which is cut perpendicular to the longitudinal direction 'a', the radius of curvature of the cross-section is large and forms a gentle curvature, whereas when viewing the heater plate 47 from the outside, it defines a concave curve. However, the opposite edges of the heater plate 47 (which are not angled ends) in the width direction 'b' extend downwards while defining a curved surface with the skirts (sides), so that when a hair slides therealong, the hair can smoothly slide without hindrance. Further, because of the formation of wider width of the lower heater block than the upper heater block, upon contact, the lower heater block covers the upper heater block.

The groove 41 has the thickened portion (wall portion), in which a hole 411 is formed in such a manner as to extend longitudinally along the groove 41 and connect the opposite longitudinal ends of the groove with each other. The hole 411 serves as the hole 311 of the metal barrel 31 of the upper heater block. Thus, synthetic resinous caps 48 and 49, which are provided on the longitudinally opposite ends of the lower heater block, and a coupler member 65 are coupled with each other in a similar manner as in the upper heater block (that is, a long bolt is fixedly screwed through the holes of these elements). Further, the coupler member 65, the lower casing 20 and the cover 63 are also coupled with each other in a similar manner (that is, the holes of these elements are aligned in a vertical direction and a bolt is fastened through the aligned holes).

A PTC or a fuse may also be installed on the heater 43 of the lower heater block to prevent overheating. For example, according to an exemplary embodiment with reference to FIG. 4, the heater block includes the heater plate 47 which is exposed to the outside and destined to come into contact with the hair, the heater 43 which is installed on the inner surface of the heater plate (i.e. which faces the inside of the lower casing) so as to generate and transfer heat, the fuse contacting the heater and upon overheating, cutting off power supply to the heater, and a fixing spring 46 for closely binding the heater plate, the heater and the fuse.

The fuse 44 serves to cut off current flowing to the heater 43, which is electrically connected with the fuse, when heat generated from the heater 44 exceeds e.g. 200° C. or 220° C., which is the maximum use temperature of the hair iron.

The fixing spring 46 is composed of a rectangular elastic steel plate frame and configured such that a portion of longitudinally opposite sides, opposite width sides or inner sides protrudes and folds to serve as a spring, thereby physically binding the heater, the heater plate and the fuse with each other in a close contact manner.

As is not shown in the drawings, a viscous silicone grease layer may be provided between the heater and the heater plate in order to uniformly distribute heat from the heater over the heater plate. It is standard for the heater plate 47 or the groove 41, and the metal barrel 31 to be made of metal, such as aluminum or stainless steel, and be applied with a ceramic coating or a Teflon coating.

Meanwhile, a lock is provided on the upper and lower casings in such a manner that a lock switch 57 (including a hook 571) is installed on the upper casing such that when the upper and lower casings come closer to each other and a user release his hold, the upper and lower casings are maintained in its holding state, and a corresponding groove 631 is installed on the lower casing 20 such that when the lock switch 57 is moved, the hook 571 engages with or disengage from the groove 631 of the lower casing.

The pivotable structure of the upper and lower casing 10 and 20 is a common structure. For example, according to an embodiment of FIG. 5, the pivotable structure is composed of a hinge structure. The upper and lower casings 10 and 20 are provided with holes 13 and 23, through which a hinge axis 73 passes, and a spring 75 is installed around the hinge axis 73. If the upper and lower casings 10 and 20 are pressurized by hand and approach each other, the heater blocks of the upper and lower casings come closer to each other, hold the hair therebetween, and transfer heat thereto. When the holding pressure is reduced, the upper and lower casings return to their widen state if the lock switch 57 is not in a locked position.

In use of the hair iron having the above-mentioned structure and shape, when straightening the hair, similar to the use of the conventional plate type hair iron, it inserts the hair between the upper and lower heater blocks and slides down along the direction of hair.

Meanwhile, when curling the hair, it may carry out various actions according to a desired curvature of the hair. For example, in the state of the hair being inserted between the upper and lower heater blocks, the hair iron is inclined to one side such that the heater plate 47 defines an angle with the hair, and then it slides down along the hair, or otherwise in the state of the hair being wound around the metal barrel 31 of the upper heater block, the hair iron is slowly drawn such that the hair slides along the surface of the metal barrel. Further, when the upper and lower casings become closer to each other through locking using the lock switch 57, the upper and lower heater blocks define a single substantially cylindrical barrel, so that upon drawing the hair around the barrel, the hair can slide along the curved portion of the upper and lower heater blocks while being in contact with the curved portion.

Here, since the portion other than the diametrical portion 315, which contacts the heater 33, of the metal barrel 31 of the upper heater block also has high heat conductivity, the entire portion of the metal barrel can serve as a heating section for shaping of the hair. Further, while the heater 43 is not installed on the groove (groove type heating section 41) of the lower heater block, the groove may be heated from the heater plate through radiation from the heater 43, which is installed on the heater plate 47, or some contact points with the heater plate, so that the groove can also be used to shape a hairstyle.

In the state of the hair being inserted between the upper and lower heater blocks, when the hair iron slides down along the hair while slanting it so that the heater plate 47 meets the hair at an angle, the hair can also slide in a smooth manner because the opposite width ends of the heater plate is curved and the heater plate is resiliently movable by means of the silicone pad 45, which fixes the heater plate 47. Thus, the problem of the hair getting caught between the upper and lower heater blocks and thereby damaging the hair or causing the scalp to suffer pain can be obviated.

In case of implementing the shaping of hair using only one hand in the state of the hair being inserted between the upper and lower heater blocks, even when the hair iron is light, it is required to hold the hair iron with a strong grip using the hand to hold the hair, so that the shaping becomes very inconvenient. Meanwhile, in case of the conventional plate type hair iron, only the surface of the heater plate 47 is exposed to the outside and the remaining portion around the heater plate 47 is covered with a synthetic resinous case, so that the hair can be held and drawn by hands while holding, with another hand, the end of the case in the side opposite to the side where the hinge is installed. Thus, such a problem is not serious.

However, in case of the hair iron of the present invention, since the heater block is not covered with a case, but substantially exposed, there is no grip portion for another hand. Thus, in order to allow the end, which is opposite to the end where the hinge is installed, to be held by another hand, the caps 38 and 48 are coupled onto the heater blocks. Further, in order to, upon placing on the bottom, prevent the metal barrel 31 or the groove 41 from coming into direct contact with the bottom, the cap is preferably configured such that it has the circumferential size larger than the metal barrel 31 or the groove 41, or otherwise it is provided with a circumferential rib, so as to form a step from the side of the metal barrel or the groove. Further, the caps 38 and 48 may be provided with tips 381 and 481, which protrude in the longitudinal direction in order to easily hold them with a hand other than the hand holding the grip portion, which ensures convenient operation upon shaping of hair.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A hair iron comprising:

upper and lower casings defining a grip portion and coupled to each other at a first end by an elastic coupler such that the casings in the side of a second end opposite to the first end are pivotable within a certain angular range about the first end;

an upper heater block extending in a longitudinal direction of the upper casing and coupled on the second end of the upper casing which is not coupled with the lower casing;

a lower heater block extending in a longitudinal direction of the lower casing and coupled on the second end of the lower casing which is not coupled with the upper casing, wherein the upper heater block has a semi-cylindrical heating section and a first heater attached to an inner part of the heating section, wherein the lower heater block has a concave heating section, a heater plate and a second heater attached to a surface of the heater plate which is not exposed outside, the heater plate being coupled onto a concave portion of the concave heating section by the medium of a heat-resistant elastic body, thereby defining the semi-cylindrical shape of the lower heater block, wherein the heater plate moves nearer towards the concave heating section or tilts (or pivots) about its longitudinal axis by the action of the elastic body so as to vary its position relative to the concave heating section.

2. The hair iron according to claim 1, wherein the lower heater block has a larger width than the upper heater block and has a concave surface so as to overlap with a convex surface of the upper heater block.

3. The hair iron according to claim 1, wherein heat-resistant, heat-insulating synthetic resinous caps are provided on the upper and lower heater blocks in the side of the second end, which is opposite to the first end, such that hands of a user hold portions of the caps so that a hairstyle is shaped while the grip portion is held by one hand and the second end is held by another hand.

4. The hair iron according to claim 1, wherein a lock is provided on the upper and lower casings in order to fix a position of the upper and lower heater blocks when coming closer to each other.

5. The hair iron according to claim 1, wherein the elastic body is composed of a silicone pad with a heat-resistant temperature of 200° C. or more.

6. The hair iron according to claim 3, wherein the synthetic resinous cap has the circumferential size larger than the semi-cylindrical heating section (or metal barrel) or the groove type heating section, or otherwise is provided with a circumferential rib, in order to form a step from the side of the semi-cylindrical heating section or the groove type heating section.

* * * * *